US010968755B2

(12) United States Patent
Bang

(10) Patent No.: US 10,968,755 B2
(45) Date of Patent: Apr. 6, 2021

(54) COOLING STRUCTURE FOR VANE

(71) Applicant: DOOSAN HEAVY INDUSTRIES & CONSTRUCTION CO., LTD, Changwon-si (KR)

(72) Inventor: Myeong Hwan Bang, Busan (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 329 days.

(21) Appl. No.: 15/835,226

(22) Filed: Dec. 7, 2017

(65) Prior Publication Data

US 2018/0163545 A1 Jun. 14, 2018

(30) Foreign Application Priority Data

Dec. 8, 2016 (KR) ..... 10-2016-0166949

(51) Int. Cl.
*F01D 5/18* (2006.01)
*F23R 3/00* (2006.01)
*F01D 25/12* (2006.01)

(52) U.S. Cl.
CPC ..... *F01D 5/189* (2013.01); *F01D 5/18* (2013.01); *F01D 5/187* (2013.01); *F01D 5/188* (2013.01); *F01D 25/12* (2013.01); *F23R 3/002* (2013.01); *F05D 2240/127* (2013.01); *F05D 2240/303* (2013.01); *F05D 2260/201* (2013.01);

(Continued)

(58) Field of Classification Search
CPC . F01D 5/188; F01D 5/189; F01D 5/18; F01D 5/186; F01D 25/12; F05D 2240/126; F05D 2240/127; F05D 2240/303; F05D 2260/201; F05D 2260/202;

(Continued)

(56) References Cited

U.S. PATENT DOCUMENTS 4,064,300 A * 12/1977 Bhangu ..... F23R 3/002 428/120
4,105,364 A * 8/1978 Dodd ..... F01D 5/189 415/115

(Continued)

FOREIGN PATENT DOCUMENTS

EP 0392664 A2 10/1990
EP 1188902 A1 * 3/2002 ..... F01D 5/189

(Continued)

OTHER PUBLICATIONS

Okita, JP 2010174688 A, Aug. 12, 2010, English Machine Translation, Translated by ProQuest May 8, 2020 (Year: 2010).*

*Primary Examiner* — Igor Kershteyn
*Assistant Examiner* — Wayne A Lambert
(74) *Attorney, Agent, or Firm* — Invenstone Patent, LLC

(57) ABSTRACT

A gas turbine vane includes a sidewall having a plurality of film holes formed therein and defining an airfoil having a leading edge and a trailing edge, a cut-back formed at the trailing edge of the airfoil defined by the sidewall, an insert spaced apart from an inner surface of the sidewall and installed within the sidewall while having a plurality of insert holes formed therein, and a plurality of posts extending from the sidewall. The plurality of insert holes are formed in a plurality of rows, the insert holes of each row are arranged at a distance from the leading edge to the trailing edge, and a surface of the insert is positioned on the posts.

15 Claims, 8 Drawing Sheets

(52) U.S. Cl.
CPC ..... *F05D 2260/202* (2013.01); *F05D 2260/2212* (2013.01); *F05D 2260/22141* (2013.01); *F23R 2900/03043* (2013.01); *F23R 2900/03044* (2013.01)

(58) Field of Classification Search
CPC ... F05D 2260/2212; F05D 2260/22141; F23R 3/002; F23R 2900/03043; F23R 2900/03044
See application file for complete search history.

(56) References Cited

U.S. PATENT DOCUMENTS 4,183,716 A * 1/1980 Takahara ..... F01D 5/189 415/115
4,446,693 A * 5/1984 Pidcock ..... F23R 3/002 60/757
4,695,247 A * 9/1987 Enzaki ..... F23R 3/06 431/352
5,223,320 A * 6/1993 Richardson ..... B32B 3/266 428/137
5,328,331 A * 7/1994 Bunker ..... F01D 5/187 415/115
5,361,828 A * 11/1994 Lee ..... F01D 5/187 165/109.1
5,533,864 A * 7/1996 Nomoto ..... F01D 5/186 415/115
6,446,710 B2 * 9/2002 Beeck ..... F01D 5/187 137/809
7,699,583 B2 * 4/2010 Cunha ..... F01D 5/186 415/115
8,186,942 B2 * 5/2012 Haas ..... B64D 33/02 244/53 B
8,668,453 B2 * 3/2014 Lee ..... F01D 5/187 416/96 R
2002/0062945 A1 * 5/2002 Hocker ..... F01D 5/189 165/53
2003/0031555 A1 * 2/2003 Noe ..... F01D 5/189 415/115
2003/0068222 A1 * 4/2003 Cunha ..... F01D 5/18 415/115
2004/0009066 A1 * 1/2004 Soechting ..... F01D 5/186 416/96 R
2004/0062649 A1 * 4/2004 Schopf ..... F01D 5/189 416/97 R
2008/0063524 A1 * 3/2008 Tibbott ..... F01D 5/187 416/95
2014/0290256 A1 10/2014 Fujimoto et al.
2014/0290257 A1 * 10/2014 Okita ..... F01D 5/189 60/752
2015/0139814 A1 * 5/2015 Horiuchi ..... F01D 5/187 416/97 R
2015/0226085 A1 * 8/2015 Spangler ..... F01D 25/12 60/806
2017/0058679 A1 * 3/2017 Spangler ..... F01D 9/041

FOREIGN PATENT DOCUMENTS

JP S52-077914 A 6/1977
JP 07-019002 A 1/1995
JP 2010174688 A 8/2010
WO 2011/020485 A1 2/2011

* cited by examiner

Prior Art

Prior Art

COOLING STRUCTURE FOR VANE

CROSS-REFERENCE TO RELATED APPLICATION

This application claims priority to Korean Patent Application No. 10-2016-0166949, filed on Dec. 8, 2016, the disclosure of which is incorporated herein by reference in its entirety.

BACKGROUND

Exemplary embodiments of the present disclosure relate to a structure for cooling a gas turbine, and more particularly, to an impingement cooling structure in a gas turbine vane.

In general, a gas turbine includes a compressor that compresses air, a combustor that mixes the compressed air with fuel for ignition, and a turbine blade assembly that produces electric power.

The combustor is operated at a high temperature above 2,500° F. The vane and blade of the turbine are typically exposed to the high temperature, and they are thus made of a material resistant to high temperature. In addition, the vane and blade of the turbine are provided with a cooling system that prolongs their life and reduces a possibility of damage due to excessive temperature.

The vane has an airfoil shape and includes a leading edge, a trailing edge, a suction surface, and a pressure surface. The vane of the turbine mostly has a complicated mirror structure that forms the cooling system therein. The cooling circuit in the vane receives a cooling fluid, e.g. air, from the compressor of the turbine engine, and the fluid passes through the cooling circuit via the end of the vane coupled to a vane carrier. Typically, the cooling circuit has a plurality of flow paths designed to maintain all surfaces of the turbine vane at a relatively uniform temperature, and at least a portion of the fluid passing through the cooling circuit is discharged through openings in the leading edge, trailing edge, suction surface, or pressure surface of the vane.

FIG. 1 illustrates two typical vane cooling methods in a cooling system.

A vane 1 has an airfoil shape, and the boundary of this airfoil is defined by a sidewall 20. An insert 50 is positioned within the sidewall 20, and a cooling fluid flows out of the insert 50 through a plurality of insert holes 51 formed in the insert to cool the inner surface of the sidewall 20. The cooling fluid, particularly cooling air, passing through the insert 50 is referred to as an impinging jet 14, and the cooling action to cool the vane by contact of the impinging jet 14 with the sidewall 20 of the vane is referred to as impingement cooling.

In addition, the flow of the impinging jet 14 is divided into a gap flow 15, in which the impinging jet 14 flows into the gap WI between the insert 50 and the sidewall 20 through the insert 50 to cool the vane and then flows toward a cut-back 40, and flows 11, 12, and 13 in which the impinging jet 14 is discharged from the vane through the film holes of the sidewall 20 to cool the sidewall 20. The cooling by the flows is referred to as film cooling. Particularly, the flows 11, 12, and 13 are referred to as film cooling flows.

FIGS. 2A and 2B are enlarged views illustrating portion A of FIG. 1, wherein they illustrate a flow of air therein. FIGS. 2A and 2B illustrate the gap flow 15 in which the impinging jet 14 introduced through the insert holes 51 impinges on the sidewall 20 and flows to the cut-back 40. The air introduced through the first insert holes 51 flows toward the cut-back 40 and then meets the air introduced through the second insert holes 51, thereby causing flow obstruction. This flow obstruction gets worse as air is introduced through the third and fourth insert holes 51. Hence, there is a problem in that cooling performance is increasingly degraded in the downstream side.

In addition, the insert is thermally expanded due to an increase in temperature of air in the insert according to the operation of the gas turbine, thereby causing non-uniformity in the distance between the sidewall 20 and the inner surface 22. Hence, cooling performance may be further degraded than that expected in the case of original design.

BRIEF SUMMARY

Accordingly, the present disclosure has been made in view of the above-mentioned problems, and an object thereof is to enhance cooling performance by improving a structure so as to reduce or prevent obstruction between a gap flow in a gap between a sidewall and an insert of a vane and an impinging jet introduced through insert holes.

Other objects and advantages of the present invention can be understood by the following description, and become apparent with reference to the embodiments of the present disclosure.

In accordance with one aspect of the present disclosure, a gas turbine vane includes a sidewall having a plurality of film holes formed therein and defining an airfoil having a leading edge and a trailing edge, a cut-back formed at the trailing edge of the airfoil defined by the sidewall, an insert spaced apart from an inner surface of the sidewall and installed within the sidewall while having a plurality of insert holes formed therein, and a plurality of posts extending from the sidewall. The plurality of insert holes are formed in a plurality of rows, the insert holes of each of the rows are arranged at a distance in a direction from the leading edge to the trailing edge, and a surface of the insert is positioned on the plurality of posts. Thus, when a gap flow in the gap between the sidewall and the insert of the vane meets each of the posts, the gap flow is divided in both directions about the post.

The plurality of posts may be fixed to the surface of the insert. Since each of the posts is adjacent and fixed to the insert, the distance between the sidewall and the insert of the vane may be uniformly maintained at a height of the post even though the vane is heated to high temperature and the insert and the vane are thermally deformed.

Each of the plurality of posts may be positioned between two insert holes arranged in each of the rows of the plurality of insert holes. Since each row of the insert holes is mostly formed in the direction from the leading edge to the trailing edge of the vane, the holes and the posts may be configured in order of first insert hole—post—second insert hole—post—third insert hole in the direction of the gap flow. That is, this configuration is to disperse a path of a first gap flow before the first gap flow introduced through the first insert hole meets a second gap flow introduced through the second insert hole. Thus, it is possible to reduce or prevent a cross-flow phenomenon and to reduce obstruction between the gap flow in the gap between the sidewall and the insert and a newly introduced impinging jet.

Each of the rows of the insert holes may be offset from a row adjacent to the same. If the holes of each row are arranged in parallel as in FIG. 2, the gap flow dispersed through the first insert hole of the first row may obstruct the gap flow dispersed through the second insert hole of the second row even when the posts are disposed between the insert holes. Accordingly, it is preferable that adjacent rows be offset from each other such that the insert holes of the adjacent rows are not disposed adjacently in parallel with each other.

Each of the plurality of posts may be positioned closer to an insert hole (second insert hole), closer to the trailing edge, from among two insert holes (first and second insert holes) adjacent to the post. In order to reduce or prevent the gap flow dispersed by the post from impinging on a next introduced impinging jet, it is important to position the post close to the second insert hole.

Each of the plurality of posts may include a partition portion extending toward the leading edge from a side of the post. Since the partition portion has a shape that extends in the direction of the gap flow or in the direction opposite to the gap flow and is positioned at the leading edge rather than the post, the gap flow meets the partition portion ahead of the post and is easily dispersed to two airflows.

Preferably, the partition portion has a thinner thickness than the post, and has a curved end. When the partition portion has a curved tip, it is possible to reduce friction with the gap flow.

Preferably, both surfaces of the partition portion extend from the side of the post to the end of the partition portion without having an angular portion. More preferably, both surfaces of the partition portion extend in a streamlined form.

The plurality of posts may have a circular, semicircular, oval, triangular, or square transverse section, but the present disclosure is not limited thereto. The first portion of the side of the post directed toward the leading edge is more meaningful than the second portion thereof directed toward the trailing edge. That is, preferably, the first portion protrudes or is convex toward the leading edge. This is to disperse the gap flow to two airflows in the state in which the friction with the gap flow is reduced.

Each of the plurality of posts may have first and second sides in longitudinal section, and the second side closer to the trailing edge from among the two sides may extend toward the sidewall from the insert and toward the trailing edge from the post. It is possible to change the flow direction of impinging jet by positioning the inclined surface of the post at the introduction portion of the impinging jet. Thus, it is possible to reduce an angle difference between the impinging jet introduced through the insert holes and the gap flow proceeding already. When the angle difference is reduced, it is possible to reduce obstruction between the flows. However, the insert holes are preferably positioned above at least a portion of the inclined surface of the post in order to change the inflow angle of the impinging jet.

The second side may be curved. In detail, when the second side is streamlined rather than rectilinear, it is possible to reduce kinetic energy lost when the impinging jet impinges on the post.

The second side may be concave. In detail, the inclined surface may have a concave streamlined shape to reduce friction during introduction of impinging jet. That is, the inclined surface of the post may be concave when viewing it from the insert holes.

The gas turbine vane according to one aspect of the present disclosure includes an effective impingement cooling structure which may be implemented by the following impingement cooling system.

In accordance with another aspect of the present disclosure, an impingement cooling system includes a main body, a screen installed at a certain distance from the main body and having a plurality of inlets formed at a distance from its first side to its second side in a row, and a plurality of posts extending from one surface of the main body to one surface of the screen. Here, a fluid is introduced into the plurality of inlets and flows toward the second side, and each of the plurality of posts is adjacent to each of at least some of the plurality of inlets to be positioned closer to the first side than the inlet.

The screen may have a plurality of inlet rows formed thereon for enhancement of cooling performance.

The plurality of inlet rows may be offset from each other.

Each of the plurality of posts may be positioned closer to an inlet positioned at the second side from among two inlets adjacent to the post.

In accordance with a further aspect of the present disclosure, a gas turbine includes a compressor configured to suck and compress air to a high pressure, a combustor configured to mix the air compressed by the compressor with fuel for combustion, and a turbine configured to rotate a plurality of turbine blades using high-temperature and high-pressure combustion gas discharged from the combustor and to produce electric power. The compressor includes a plurality of compressor blades and a plurality of compressor vanes that are alternately arranged, and the turbine includes the plurality of turbine blades and a plurality of turbine vanes that are alternately arranged. At least one of the compressor vanes and the turbine vanes includes a sidewall having a plurality of film holes formed therein and defining an airfoil having a leading edge and a trailing edge, a cut-back formed at the trailing edge of the airfoil defined by the sidewall, an insert spaced apart from an inner surface of the sidewall and installed within the sidewall while having a plurality of insert holes formed therein, and a plurality of posts extending from the sidewall. The plurality of insert holes are formed in a plurality of rows, the insert holes of each of the rows are arranged at a distance in a direction from the leading edge to the trailing edge, and a surface of the insert is positioned on the plurality of posts. Thus, when a gap flow in the gap between the sidewall and the insert of the vane meets each of the posts, the gap flow is divided in both directions about the post.

The plurality of posts may be fixed to the surface of the insert.

Each of the plurality of posts may be positioned between two insert holes arranged in each of the rows.

Each of the rows may be offset from a row adjacent to the same.

Each of the plurality of posts may be positioned closer to an insert hole, closer to the trailing edge, from among two insert holes adjacent to the post.

Each of the plurality of posts may include a partition portion extending toward the leading edge from a side of the post.

It is to be understood that both the foregoing general description and the following detailed description o are exemplary and explanatory.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
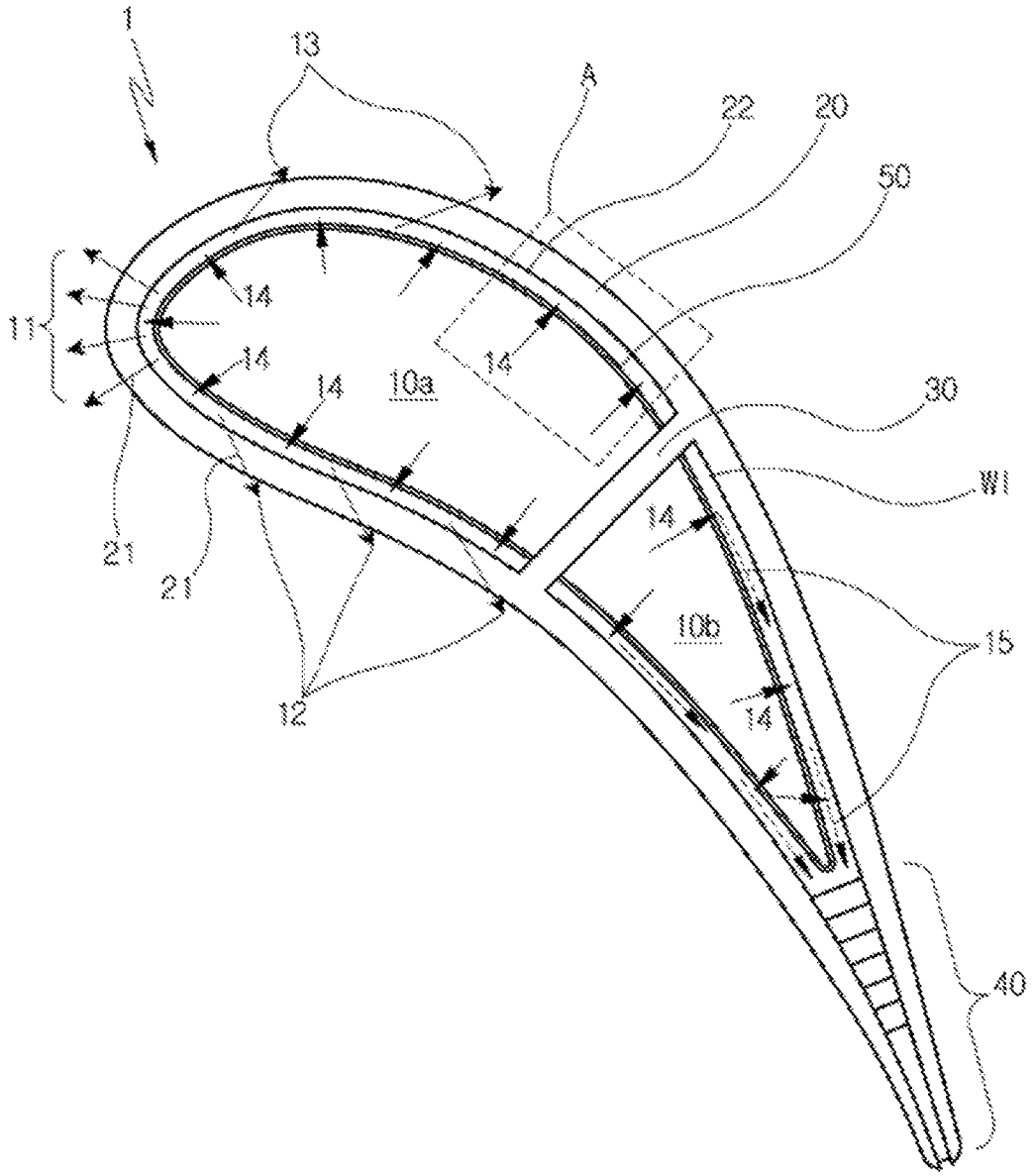
FIG. 1 is a cross-sectional view illustrating a vane having an airfoil structure and a cooling structure.
Figure 2A:
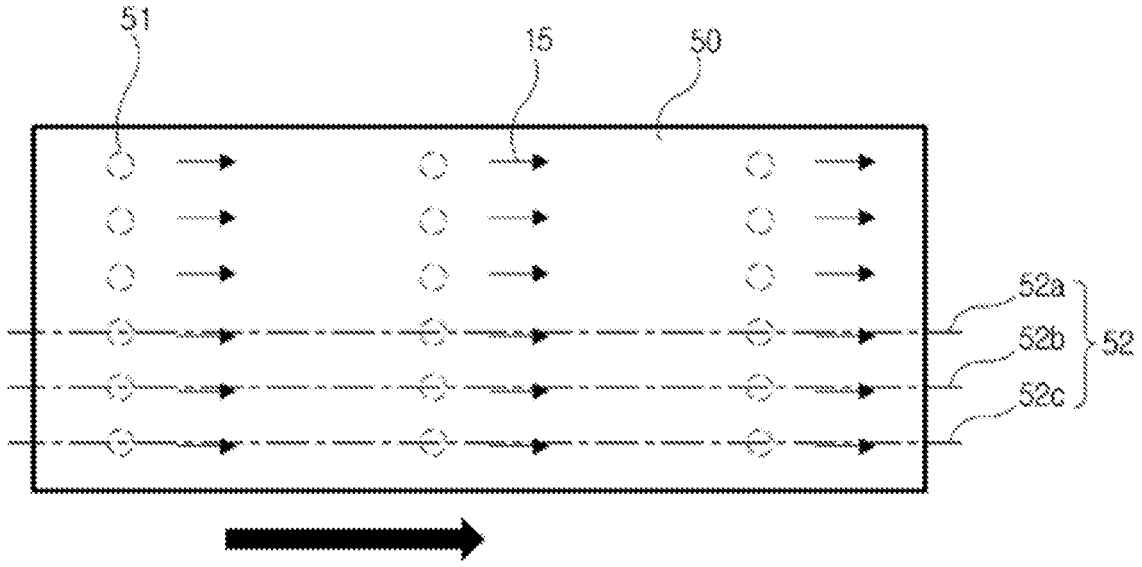
FIG. 2A is a vertical cross-sectional view illustrating arrangement of insert holes and a direction of gap flow between a sidewall and an insert of a vane in a gas turbine.
Figure 2B:
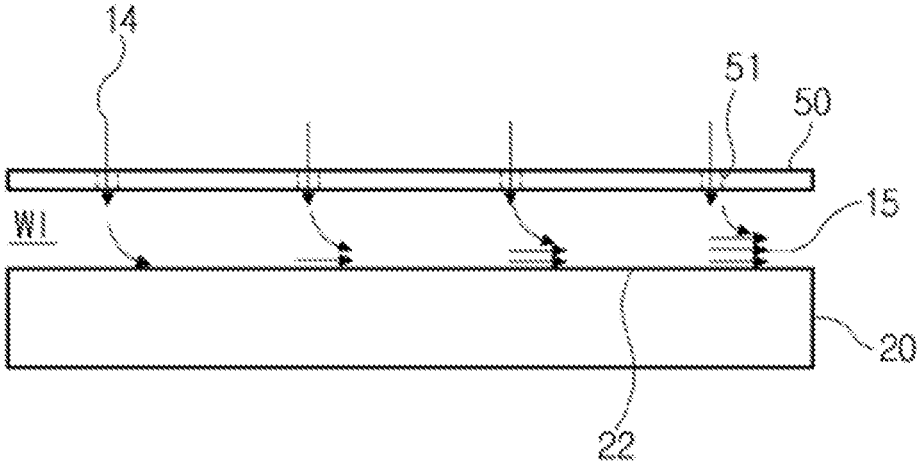
Prior Art FIG. 2B
FIG. 2B is an enlarged horizontal cross-sectional view illustrating portion A of FIG. 1, wherein it illustrates directions of impinging jet and gap flow in the gas turbine.

Exemplary embodiments of the present disclosure will be described below in more detail with reference to the accompanying drawings. The embodiments may be provided in different forms and the present disclosure should not be construed as limited to the embodiments set forth herein. Throughout the disclosure, like reference numerals refer to like parts throughout the various figures and embodiments.

Hereinafter, a gas turbine vane according to an embodiment of the present disclosure will be described in detail with reference to the accompanying drawings.

Figure 3:
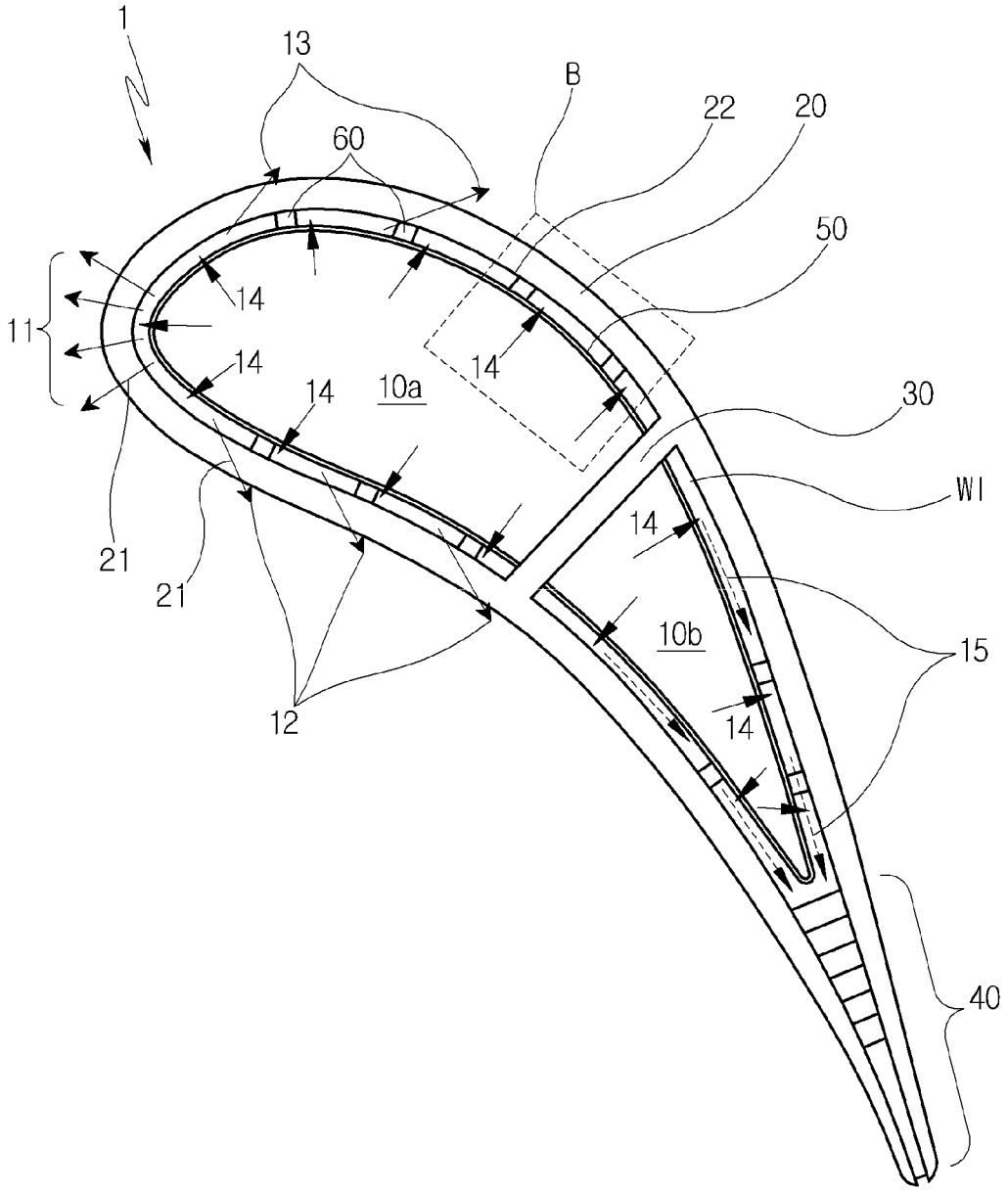
FIG. 3 is a horizontal cross-sectional view illustrating a gas turbine vane according to an embodiment of the present disclosure.

FIG. 3 is a horizontal cross-sectional view illustrating a gas turbine vane according to an embodiment of the present disclosure. The vane, which is designated by reference numeral 1, a sidewall 20 that defines an airfoil shape, a partition 30 that partitions a path in which an introduced cooling fluid flows, an insert 50 that is disposed within the sidewall 20 at a distance from an inner surface 22 of the sidewall, and a plurality of posts 60 that are disposed between the sidewall 20 and the insert 50.

The insert 50 has a large number of insert holes 51 formed therein. The cooling fluid, particularly cooling air, introduced into inflow chambers 10*a* and 10*b* is introduced into a gap WI between the sidewall 20 and the insert 50 through the insert holes 51 to cool the sidewall 20.

In addition, the sidewall 20 has film holes 21 formed therein for film cooling. The cooling air introduced into the gap WI serves to directly cool the sidewall 20 while passing through the film holes 21.

The distance between the insert holes 51 may be different for each portion of the vane 1 since the portions of the vane 1 may preferably be cooled in a different manner. For example, since a leading edge through which the most first film cooling flow 11 passes is in contact with air having the highest temperature in FIG. 3, it is important to cool the leading edge. Therefore, it is preferable that the distance between the film holes 21 be small.

Similarly, the insert holes 51 of the insert 50, through which the cooling fluid primarily passes, may also be distributed more in the leading edge.

The film cooling flow includes a second film cooling flow 12 that is discharged to a pressure surface and a third film cooling flow 13 that is discharged to a suction surface, in addition to the first film cooling flow 11. A portion of the gap flow 15 in the gap WI is discharged as film cooling flows 11, 12, and 13, and the other is discharged to a cut-back 40.

The gap flow 15 joins, for example, all of impinging jets 14 introduced through first insert holes 51*a* adjacent to the leading edge, second insert holes 51*b* positioned next to the first insert holes, and third insert holes 51*c* adjacent to the trailing edge, while the gap flow 15 proceeds from the leading edge to the trailing edge. In this case, the gap flow 15 first meets one of the posts 60 before it joins each of the impinging jets 14.

Figure 4:
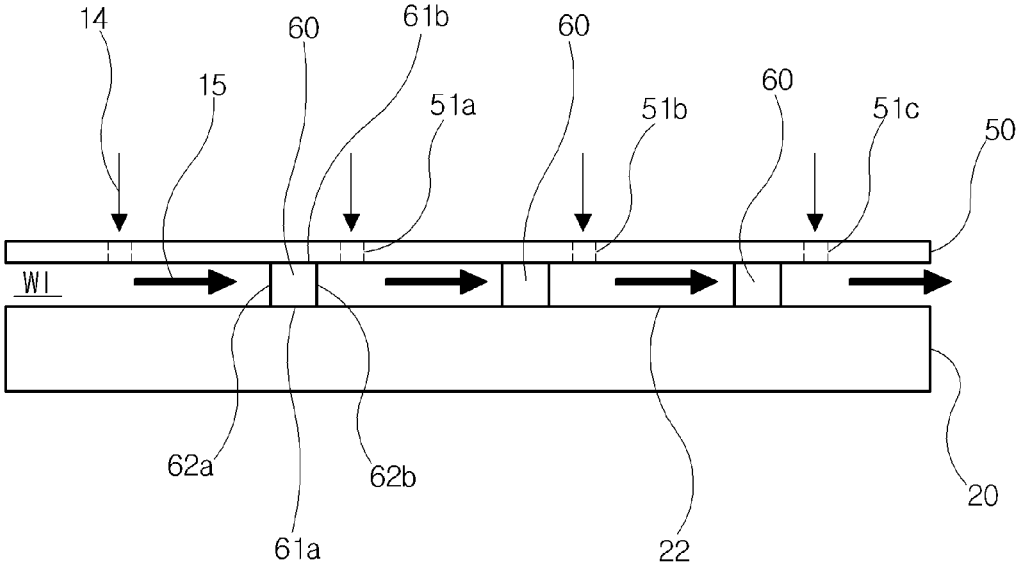
FIG. 4 is an enlarged horizontal cross-sectional view illustrating portion B of FIG. 3, wherein it illustrates directions of impinging jet and gap flow.

FIG. 4 is an enlarged horizontal cross-sectional view illustrating portion B of FIG. 3, wherein it illustrates the directions of the impinging jet 14 and the gap flow 15. The impinging jet 14 is introduced into the gap WI through the insert holes 51. The gap flow 15, which is introduced through the insert hole 51 closest to the leading edge (the leftmost hole in FIG. 4) to cool the vane and flows toward the trailing edge, first meets one of the posts 60 before it meets the impinging jet introduced through the first insert holes 51*a*. Thus, the impinging jet and the gap flow 15 do not impinge on each other but join behind the post 60.

The gap flow 15 joined beneath the first insert holes 51*a* passes through another post 60 to join the impinging jet introduced through the second insert holes 51*b*, and then passes through a still another post 60 to join the impinging jet introduced through the third insert holes 51*c*. Through such a structure, it is possible to reduce or prevent a cross-flow phenomenon.

Figure 5:
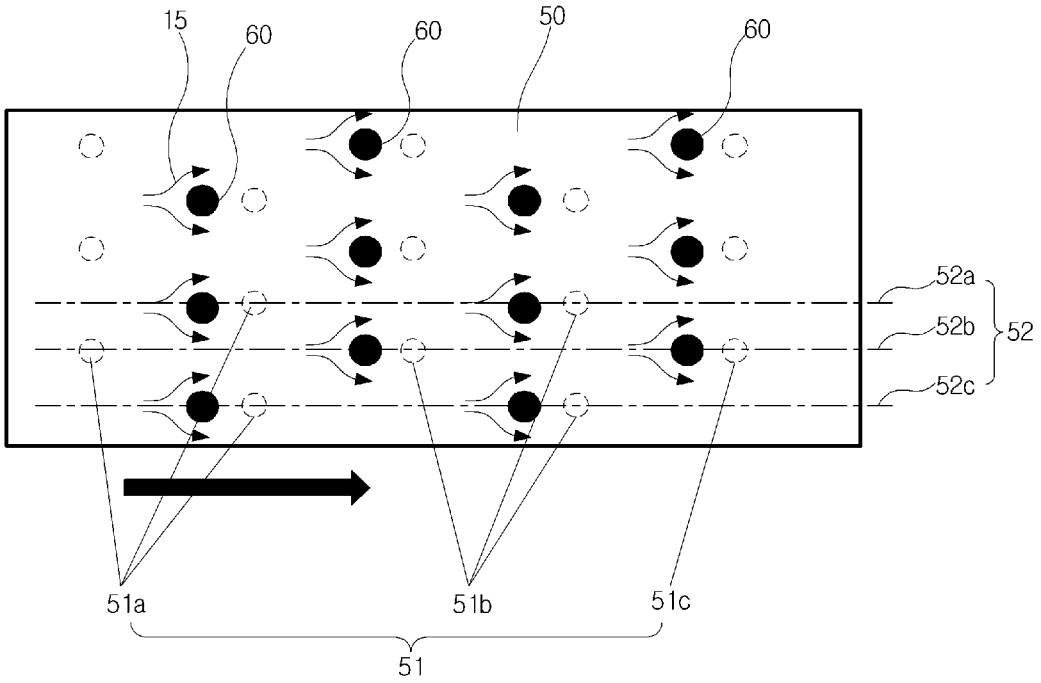
FIG. 5 is a vertical cross-sectional view illustrating a direction of gap flow between a sidewall and an insert of the gas turbine vane according to the embodiment of the present disclosure.

FIG. 5 is a view for the understanding of reduction or prevention of the above cross-flow phenomenon. In FIG. 5, the black circle refers to a cross section of each of the posts 60. The gap flow 15 proceeds in the direction from left to right in the drawing, and the cut-back 40 is positioned to the right. Although six rows 52 of the insert holes 51 are illustrated in the drawing, only first, second, and third rows 52*a*, 52*b*, and 52*c* will be given for the convenience of description.

The first, second, and third rows 52*a*, 52*b*, and 52*c* are offset from each other. That is, the insert holes included in a specific row and the insert holes included in an adjacent row are aligned so as not to be disposed adjacently in parallel with each other. In more detail, the first insert holes 51*a* of the first row 52*a* are closer to the cut-back 40 than the first insert holes 51*a* of the second row 52*b*, and the first insert holes 51*a* of the second row 52*b* are closer to the leading edge than the first insert holes 51*a* of the third row 52*c*. This offset structure causes the following effects: firstly reducing or preventing the impinging jets introduced through the insert holes included in the adjacent rows 52 from impinging on each other; and secondly reducing or preventing energy offset by contact of the airflow, which is dispersed to both sides by the posts 60 disposed in the specific row 52, with the airflow which is dispersed to both sides by the posts 60 disposed in the adjacent row 52.

Since the impinging jet 14 introduced through the insert holes 51 does not immediately meet the gap flow 15 proceeding already, as seen in FIG. 5, it is possible to directly cool the inner surface 22 of the sidewall 20 corresponding to the insert holes 51, without causing cross flow.

Figure 6:
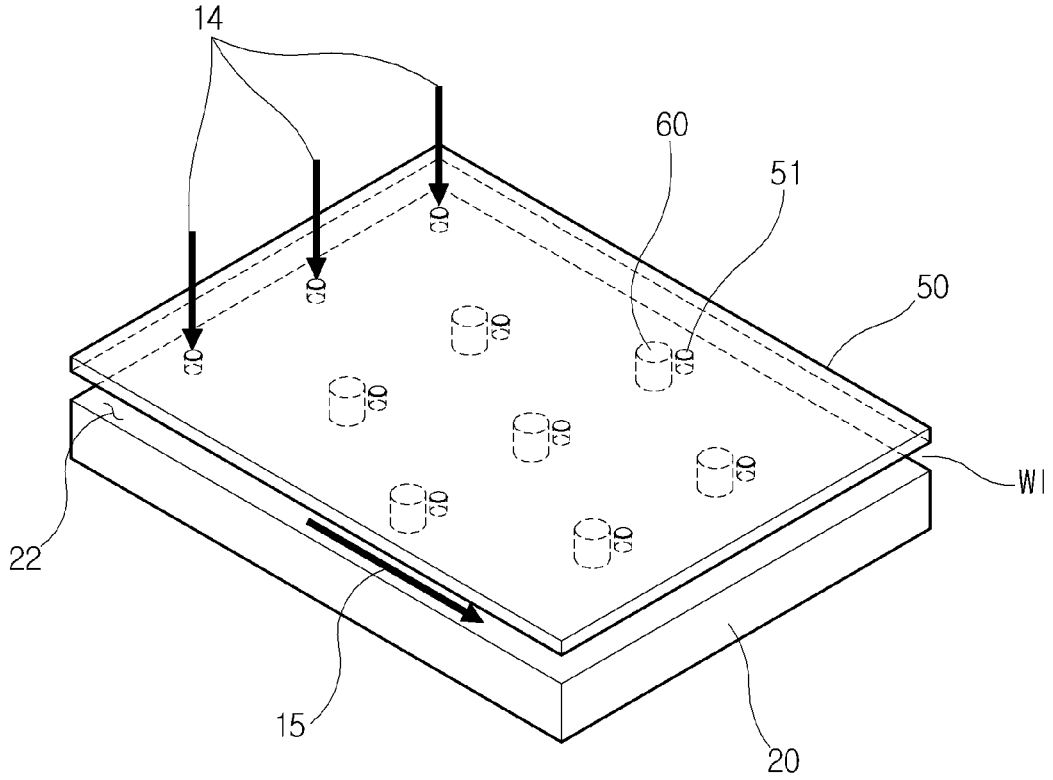
FIG. 6 is a perspective view illustrating the sidewall and the insert of the gas turbine vane according to the embodiment of the present disclosure.

FIG. 6 is a perspective view illustrating the sidewall and the insert of the gas turbine vane according to the embodiment of the present disclosure. Each of the posts 60 is positioned in front of the associated insert hole 51 in the direction of the gap flow 15. The post 60 is positioned between the first insert hole 51*a* and the second insert hole 51*b*, and it is preferably installed closer to the second insert hole 51*b*. The reason the post 60 is installed closer to the next insert hole 51 is because it is possible to increase or maximize prevention of cross flow.

Figure 7:
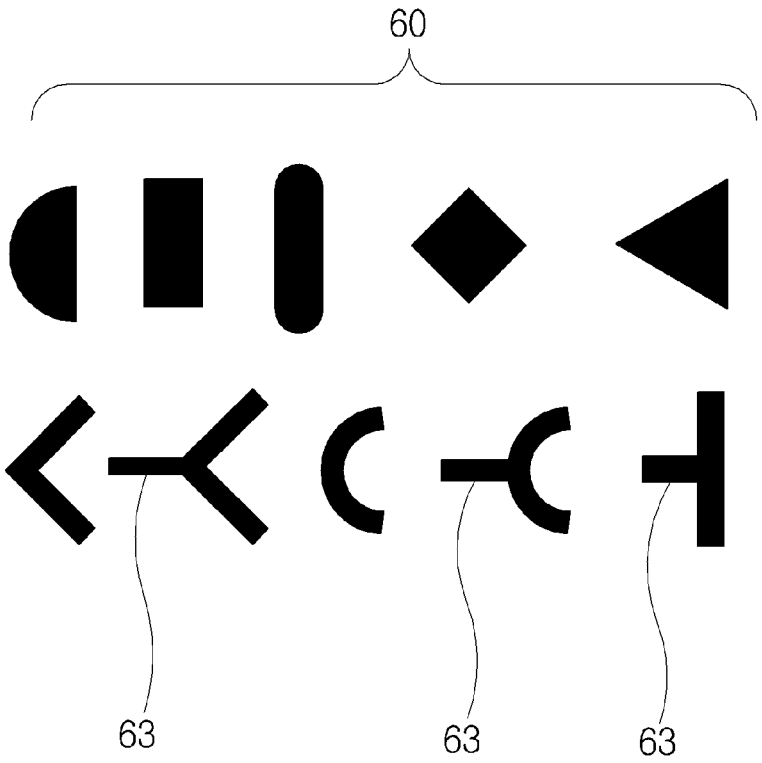
FIG. 7 is a cross-sectional view illustrating examples of transverse sections of a plurality of posts applicable to a gas turbine according to an embodiment of the present disclosure.

FIG. 7 is a cross-sectional view illustrating examples of transverse sections of the plurality of posts applicable to a gas turbine according to an embodiment of the present disclosure. Each of the posts 60 may have various shapes such as a polygonal shape, for example, a circular shape, a rectangular shape, an oval shape, a trapezoidal shape, or a triangular shape, and a partition shape, for dispersion of the gap flow 15.

In the cross-sectional view of FIG. 7, a first side 62*a* of the post 60, which meets the gap flow 15, preferably has a protruding triangular shape or a streamlined semicircular shape at the center thereof. This is to reduce friction with the gap flow 15, and cooling performance is thus enhanced in the downstream side as the friction is reduced.

In the case where the post 60 has a partition shape as in the lower row of FIG. 7, it helps to reduce the weight of the vane.

Preferably, the post 60 has a partition portion 63 extending in the left direction therefrom as in the second and fourth cross sections illustrated in the lower row of FIG. 7. The partition portion 63 is effective in reducing or minimizing friction and dispersing the gap flow 15 to two airflows. Preferably, the partition portion 63 has a streamlined end.

Moreover, both surfaces of the partition portion 63 may extend from the side of the post 60 to the end of the partition portion 63 in a streamlined form. This is very effective in reducing frictional force. The partition portion 63 may be applied to the polygonal post illustrated in the upper row of FIG. 7 as well as the partition post illustrated in the lower row of FIG. 7.

In addition, both surfaces of the partition portion 63 do not preferably have an angular portion. This angular portion may cause a vortex of the gap flow 15 and increase friction. Accordingly, the surfaces of the partition portion 63 may have a convex or concave streamlined shape or a streamlined shape that includes both of convex and concave portions. In the latter, the surfaces of the partition portion 63 may have an inflection point in the transverse section of the post 60.

The post 60 may have a fin or honeycomb structure therein. This contributes to an improvement in heat transfer and a reduction in weight.

Figure 10:
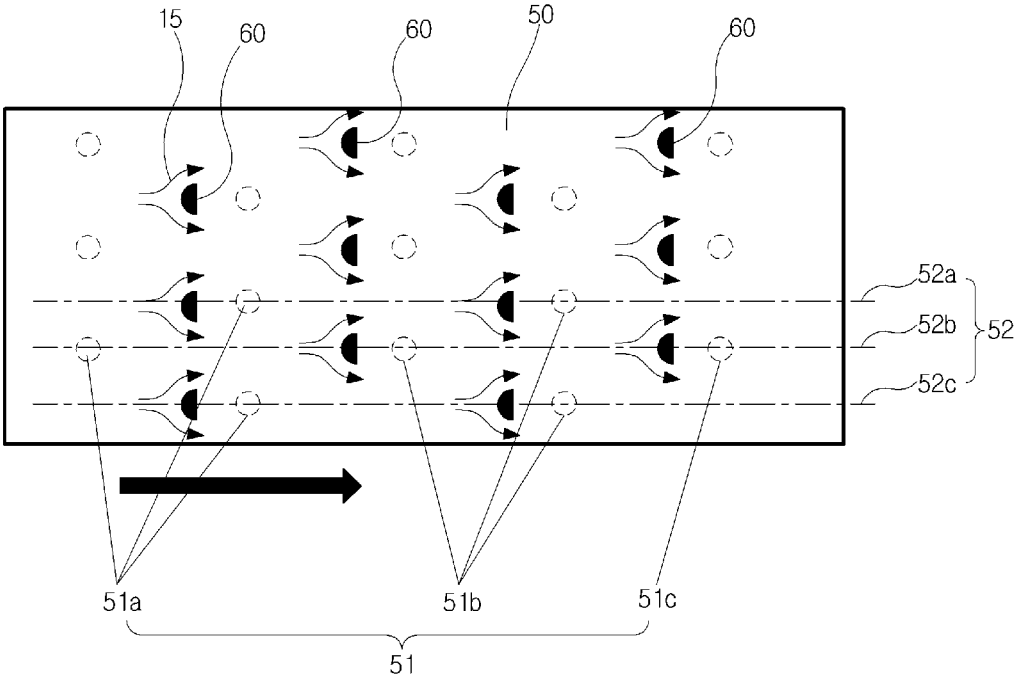
FIG. 10 is a cross-sectional view of FIG. 5 when each of the posts has a semicircular transverse section.
Figure 11:
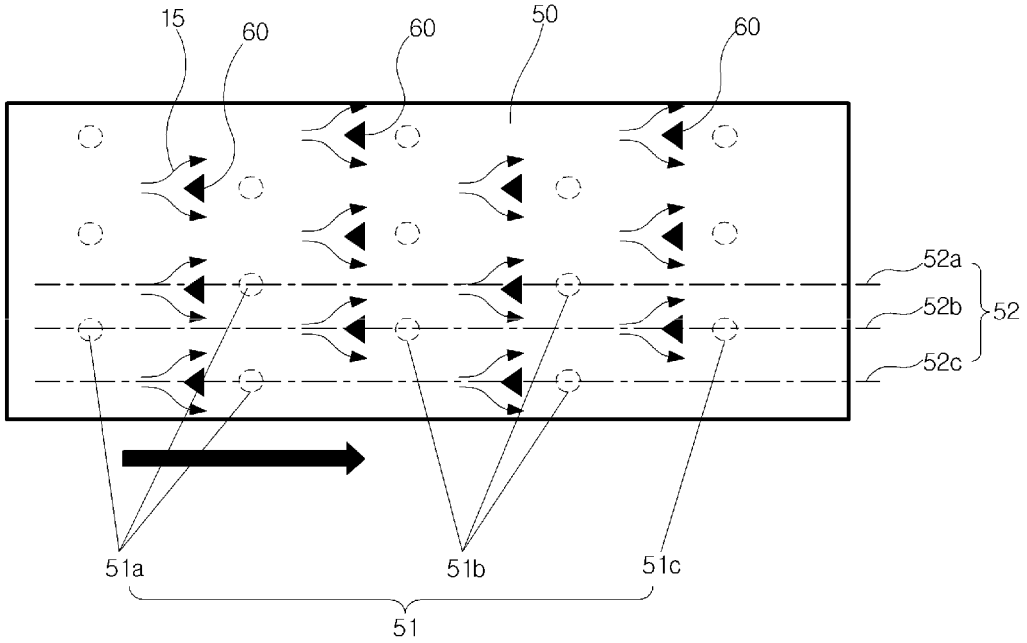
FIG. 11 is a cross-sectional view of FIG. 5 when each of the posts has a triangular transverse section.

FIG. 10 is a cross-sectional view of FIG. 5 when the post 60 has a semicircular transverse section. FIG. 11 is a cross-sectional view of FIG. 5 when the post has a triangular transverse section. That is, FIGS. 10 and 11 illustrate some of various cross sections of the posts 60 illustrated in FIG. 7.

Figure 8:
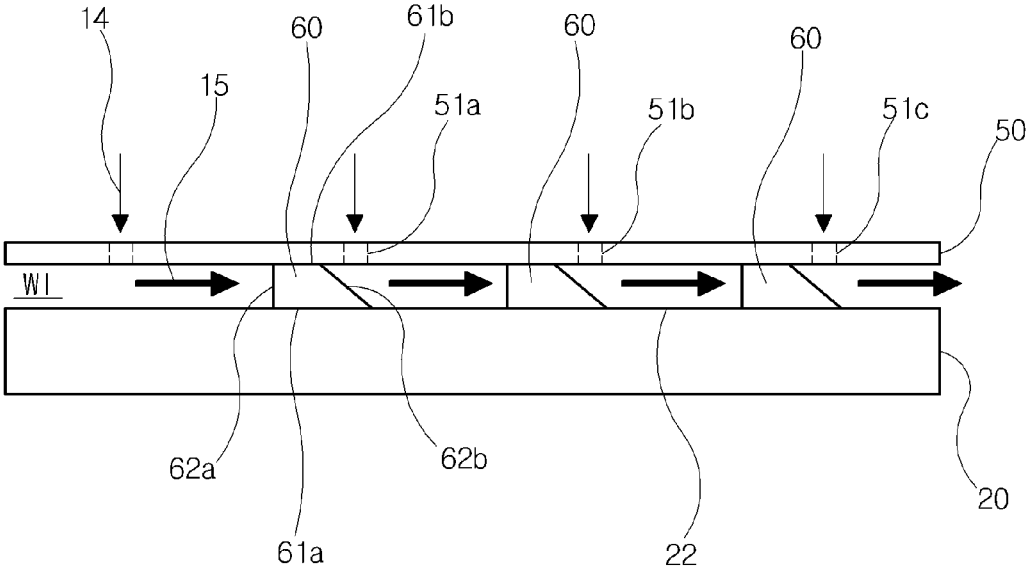
FIG. 8 is a cross-sectional view of FIG. 4 when each of the posts has an inclined surface.

FIG. 8 is a cross-sectional view of FIG. 4 when the post 60 has an inclined surface. The impinging jet 14 is introduced into the gap WI through the insert holes 51. The gap flow 15, which is introduced through the insert hole 51 closest to the leading edge to cool the vane and flows toward the trailing edge, first meets one of the posts 60 before it meets the impinging jet introduced through the first insert holes 51*a*. Thus, the impinging jet and the gap flow 15 do not impinge on each other but join behind the post 60.

Meanwhile, each of the insert holes 51 is positioned above a second side 62*b* of the associated post 60. Accordingly, the post 60 is cooled by the impinging jet 14 introduced through the insert hole 51, and the impinging jet 14 flows along the second side 62*b* of the post 60 so that the flow direction of the impinging jet 14 is naturally changed similar to the direction of the gap flow 15. Therefore, since the cross-flow phenomenon is further reduced while an angle difference of both flows is reduced, a cooling efficiency can be increased in the downstream side. Moreover, since the post 60 itself is made of a material having high heat transfer and has a fin structure, it is possible to further increase an impingement cooling effect. In addition, since the first end 61*a* of the post 60 is connected to the sidewall 20 and the second end 61*b* thereof is connected to the insert 50, heat is transferred from the insert 50 to the sidewall 20, thereby further helping to radiate heat outward.

The gap flow 15 joined beneath the first insert holes 51*a* passes through another post 60 to join the impinging jet introduced through the second insert holes 51*b*, and then passes through a still another post 60 to join the impinging jet introduced through the third insert holes 51*c*. Through such a structure, it is possible to reduce or prevent the cross-flow phenomenon.

Figure 9:
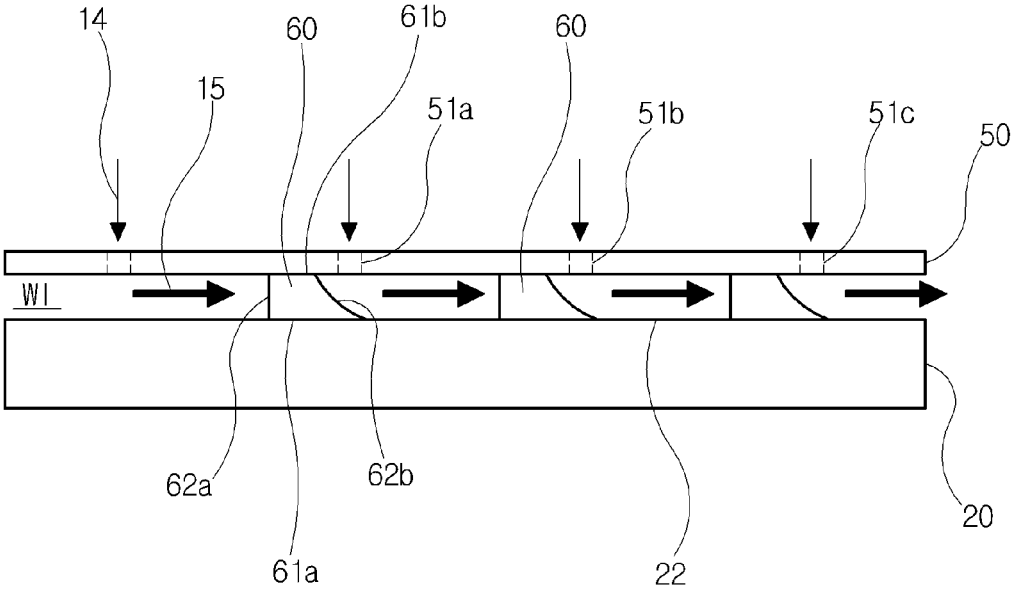
FIG. 9 is a cross-sectional view of FIG. 8 when the inclined surface is a curved surface.

FIG. 9 is a cross-sectional view of FIG. 7 when the inclined surface is a curved surface. Since the embodiment of FIG. 9 is nearly similar to that of FIG. 8, reference is made to the description of FIG. 8 that will not be repeated for brevity. The embodiment of FIG. 9 differs from that of FIG. 8 in that the second side 62*b* of the post 60 has a concave streamlined shape. The streamlined second side 62*b* is advantageous in that it reduces friction with the impinging jet 14 and naturally changes the flow direction of the impinging jet 14 to the direction of the gap flow 15.

Figure 12:
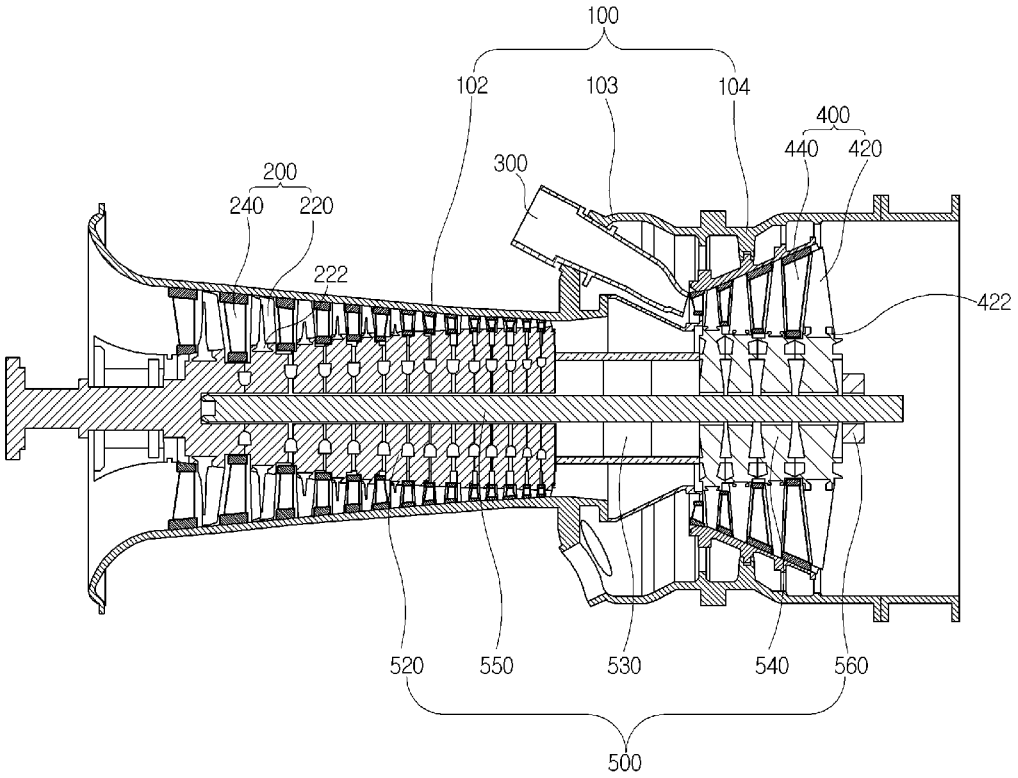
FIG. 12 is a cross-sectional view schematically illustrating the gas turbine according to the embodiment of the present disclosure.

Hereinafter, a gas turbine according to an embodiment of the present disclosure will be described in detail with reference to FIG. 12.

The gas turbine according to the embodiment may include a casing 100, a compressor 200 that is disposed in the casing 100 to draw and compress air to a high pressure, a combustor 300 that mixes the air compressed by the compressor 200 with fuel for combustion, and a turbine 400 that rotates a plurality of turbine blades using the high-temperature and high-pressure combustion gas discharged from the combustor 300 to produce electric power.

The casing 100 may include a compressor casing 102 for accommodating the compressor 200 therein, a combustor casing 103 for accommodating the combustor 300 therein, and a turbine casing 104 for accommodating the turbine 400 therein, but the present invention is not limited thereto. For example, the compressor casing, the combustor casing, and the turbine casing may also be formed integrally.

Here, the compressor casing 102, the combustor casing 103, and the turbine casing 104 may be sequentially arranged from upstream to downstream in the flow direction of fluid.

A rotor (rotary shaft) 500 may be rotatably provided in the casing 100, a generator may be connected to the rotor 500 for power generation, and a diffuser may be provided downstream of the casing 100 to discharge the combustion gas passing through the turbine 400.

The rotor 500 may include a compressor rotor disc 520 that is accommodated in the compressor casing 102, a turbine rotor disc 540 that is accommodated in the turbine casing 104, a torque tube 530 that is accommodated in the combustor casing 103 and connects the compressor rotor disc 520 to the turbine rotor disc 540, and a tie rod 550 and a fixing nut 560 that fasten the compressor rotor disc 520, the torque tube 530, and the turbine rotor disc 540 to each other.

The compressor rotor disc 520 may include a plurality of compressor rotor discs (for example, 14 sheets), and the plurality of compressor rotor discs 520 may be arranged in the axial direction of the rotor 500. That is, the compressor rotor discs 520 may be formed in a multistage manner.

In addition, each of the compressor rotor discs 520 may have a substantially disc shape, and may have a compressor blade coupling slot formed in the outer peripheral portion thereof for coupling with a compressor blade 220 to be described later.

The turbine rotor disc 540 may be formed similar to the compressor rotor disc 520. That is, the turbine rotor disc 540 may include a plurality of turbine rotor discs, and the plurality of turbine rotor discs 540 may be arranged in the axial direction of the rotor 500. That is, the turbine rotor discs 540 may be formed in a multistage manner.

In addition, each of the turbine rotor discs 540 may have a substantially disc shape, and may have a turbine blade coupling slot formed in the outer peripheral portion thereof for coupling with a turbine blade 420 to be described later.

The torque tube 530 is a torque transmission member that transmits the rotary force of the turbine rotor disc 540 to the compressor rotor disc 520. One end of the torque tube 530 may be fastened to the most downstream compressor rotor disc in the flow direction of air from among the plurality of compressor rotor discs 520, and the other end of the torque tube 530 may be fastened to the most upstream turbine rotor disc in the flow direction of combustion gas from among the plurality of turbine rotor discs 540. Here, each of the ends of the torque tube 530 may have a protrusion formed thereon, and each of the compressor rotor disc 520 and the turbine rotor disc 540 may have a groove engaged with the protrusion. Thus, it is possible to reduce or prevent the torque tube 530 from rotating relative to the compressor rotor disc 520 and the turbine rotor disc 540.

In addition, the torque tube 530 may have a hollow cylindrical shape such that the air supplied from the compressor 200 flows to the turbine 400 through the torque tube 530.

In this case, the torque tube 530 may be resistant to deformation and distortion due to the characteristics of the gas turbine that is continuously operated for a long time, and may be easily assembled and disassembled for ease of maintenance.

The tie rod 550 may be formed to pass through the plurality of compressor rotor discs 520, the torque tube 530, and the plurality of turbine rotor discs 540. One end of the tie rod 550 may be fastened to the most upstream compressor rotor disc in the flow direction of air from among the plurality of compressor rotor discs 520, and the other end of the tie rod 550 may protrude in the direction opposite to the compressor 200, on the basis of the most downstream turbine rotor disc in the flow direction of combustion gas from among the plurality of turbine rotor discs 540, so as to be fastened to the fixing nut 560.

Here, the fixing nut 560 presses the most downstream turbine rotor disc 540 to the compressor 200 to reduce the distance between the most upstream compressor rotor disc 520 and the most downstream turbine rotor disc 540. Thus, the plurality of compressor rotor discs 520, the torque tube 530, and the plurality of turbine rotor discs 540 may be compressed in the axial direction of the rotor 500. Therefore, it is possible to prevent the axial movement and relative rotation of the plurality of compressor rotor discs 520, the torque tube 530, and the plurality of turbine rotor discs 540.

Meanwhile, although one tie rod is formed to pass through the centers of the plurality of compressor rotor discs 520, the torque tube 530, and the plurality of turbine rotor discs 540 in the present embodiment, the present disclosure is not limited thereto. That is, a separate tie rod may be provided in each of the compressor and the turbine, a plurality of tie rods may be arranged circumferentially and radially, or a combination thereof may be used.

Through such a configuration, both ends of the rotor 500 may be rotatably supported by bearings and one end thereof may be connected to the drive shaft of the generator.

The compressor 200 may include a compressor blade 220 that rotates along with the rotor 500, and a compressor vane 240 that is installed in the casing 100 to align the flow of air introduced into the compressor blade 220.

The compressor blade 220 may include a plurality of compressor blades, the plurality of compressor blades 220 may be formed as a plurality of stages in the axial direction of the rotor 500, and the plurality of compressor blades 220 may be formed radially in the direction of rotation of the rotor 500 for each stage.

That is, a root part 222 of the compressor blade 220 may be coupled to the compressor blade coupling slot of the compressor rotor disc 520, and the root part 222 may have a fir-tree shape to prevent decoupling of the compressor blade 220 from the compressor blade coupling slot in the direction of rotation of the rotor 500.

In this case, the compressor blade coupling slot may have a fir-tree shape so as to correspond to the root part 222 of the compressor blade.

Although the compressor blade root part 222 and the compressor blade coupling slot have a fir-tree shape in the present embodiment, the present disclosure is not limited thereto. For example, they may also have a dovetail shape. In addition, the compressor blade may be fastened to the compressor rotor disc using a fastener other than the above form, for example using a fixture such as a key or a bolt.

Here, the compressor rotor disc 520 may be coupled to the compressor blade 220 in a tangential or axial type manner. In the present embodiment, the compressor blade root part 222 is inserted into the compressor blade coupling slot in the axial direction of the rotor 500 in an axial type manner, as described above. Thus, the compressor blade coupling slot may include a plurality of compressor blade coupling slots and the plurality of compressor blade coupling slots may be arranged radially in the circumferential direction of the compressor rotor disc 520.

The compressor vane 240 may include a plurality of compressor vanes, and the plurality of compressor vanes 240 may be formed as a plurality of stages in the axial direction of the rotor 500. Here, the compressor vane 240 and the compressor blade 220 may be arranged alternately in the flow direction of air.

In addition, the plurality of compressor vanes 240 may be formed radially in the direction of rotation of the rotor 500 for each stage.

In this case, some of the plurality of compressor vanes 240 may correspond to variable guide vanes that are coupled to the compressor casing 102 such that the angles of the vanes are adjustable to regulate an inflow amount of air introduced into the compressor 200.

The combustor 300 may mix the air introduced from the compressor 200 with fuel for combustion and produce high-temperature and high-pressure combustion gas having high energy. The combustor 300 may increase the temperature of the combustion gas to a heat-resistant temperature at which the combustor and the turbine are able to be withstood.

In detail, the combustor 300 may include a plurality of combustors, and the plurality of combustors 300 may be arranged in the direction of rotation of the rotor 500 in the combustor casing.

In addition, each of the combustors 300 may include a liner into which the air compressed by the compressor 200 is introduced, a burner that injects fuel into the air introduced into the liner for combustion, and a transition piece that guides the combustion gas generated by the burner to the turbine.

The liner may include a flame container that defines a combustion chamber, and a flow sleeve that surrounds the flame container and defines an annular space.

The burner may include a fuel injection nozzle that is formed at the front end of the liner to inject fuel into the air introduced into the combustion chamber, and an ignition plug that is formed on the wall of the liner to ignite a mixture of air and fuel mixed in the combustion.

The transition piece may be configured such that the outer wall thereof is cooled by the air supplied from the compressor so as to prevent damage of the transition piece due to the high temperature of combustion gas.

That is, the transition piece may have a cooling hole formed for injection of air thereinto, and the main body may be cooled by the air introduced through the cooling hole.

Meanwhile, the air used to cool the transition piece may flow into the annular space of the liner, and may impinge on the cooling air supplied through the cooling hole formed in the flow sleeve from the outside of the flow sleeve in the outer wall of the liner.

Here, although not separately illustrated, a desworler serving as a guide vane may be formed between the compressor 200 and the combustor 300 to adjust the flow angle of air introduced into the combustor 300 to a design flow angle.

The turbine 400 may be formed similar to the compressor 200. That is, the turbine 400 may include a turbine blade 420 that rotates along with the rotor 500, and a turbine vane 440 that is fixedly installed in the casing 100 to align the flow of air introduced into the turbine blade 420.

The turbine blade 420 may include a plurality of turbine blades, the plurality of turbine blades 420 may be formed as a plurality of stages in the axial direction of the rotor 500, and the plurality of turbine blades 420 may be formed radially in the direction of rotation of the rotor 500 for each stage.

That is, a root part 422 of the turbine blade 420 may be coupled to the turbine blade coupling slot of the turbine rotor disc 540, and the root part 422 may have a fir-tree shape to reduce or prevent decoupling of the turbine blade 420 from the turbine blade coupling slot in the direction of rotation of the rotor 500.

In this case, the turbine blade coupling slot may have a fir-tree shape so as to correspond to the root part 422 of the turbine blade.

Although the turbine blade root part 422 and the turbine blade coupling slot have a fir-tree shape in the present embodiment, the present disclosure is not limited thereto. For example, they may also have a dovetail shape. In addition, the turbine blade may be fastened to the turbine rotor disc using a fastener other than the above form, for example using a fixture such as a key or a bolt.

Here, the turbine rotor disc 540 is typically coupled to the turbine blade 420 in a tangential or axial type manner. In the present embodiment, the turbine blade root part 422 is inserted into the turbine blade coupling slot in the axial direction of the rotor 500 in a so-called axial type manner, as described above. Thus, the turbine blade coupling slot may include a plurality of turbine blade coupling slots and the plurality of turbine blade coupling slots may be arranged radially in the circumferential direction of the turbine rotor disc 540.

The turbine vane 440 may include a plurality of turbine vanes, and the plurality of turbine vanes 440 may be formed as a plurality of stages in the axial direction of the rotor 500. Here, the turbine vane 440 and the turbine blade 420 may be arranged alternately in the flow direction of air.

In addition, the plurality of turbine vanes 440 may be formed radially in the direction of rotation of the rotor 500 for each stage.

Here, since the turbine 400 comes into contact with high-temperature and high-pressure combustion gas unlike the compressor 200, it is preferable to include a cooling mechanism to reduce or prevent damage such as deterioration.

Thus, the gas turbine according to the embodiment may further include a cooling passage through which air compressed at a partial position of the compressor 200 is added and supplied to the turbine 400.

The cooling passage may extend from the outside of the casing 100 (external passage), may extend through the inside of the rotor 500 (internal passage), or may use both of external and internal passages, according to an embodiment.

In this case, the cooling passage may communicate with a turbine blade cooling passage formed in the turbine blade 420 such that the turbine blade 420 is cooled by cooling air.

In addition, the turbine blade cooling passage may communicate with a turbine blade film cooling hole formed on the surface of the turbine blade 420 so that cooling air is supplied to the surface of the turbine blade 420, thereby enabling the turbine blade 420 to be cooled by the cooling air in a so-called film cooling manner.

Besides, the turbine vane 440 may also be cooled by the cooling air supplied from the cooling passage, similar to the turbine blade 420.

In the gas turbine 1 having such a configuration, the air introduced into the casing 100 may be compressed by the compressor 200, the air compressed by the compressor may be mixed with fuel and be combusted by the combustor 300 and then be changed to combustion gas, the combustion gas generated by the combustor may be introduced into the turbine 400, the combustion gas introduced into the turbine 400 may rotate the rotor 500 through the turbine blade 420 and then be discharged to the atmosphere through the diffuser, and the rotor 500 rotated by the combustion gas may drive the compressor 200 and the generator. That is, some of mechanical energy obtained from the turbine may be supplied as energy for compression of air in the compressor, and the other may be used to produce electric power by the generator.

Here, at least one of the compressor vane 240 and the turbine vane 440 may correspond to the gas turbine vane 1 according to the embodiment of the present disclosure.

The gas turbine is given merely by way of example, and the above-mentioned gas turbine vane 1 is applicable to all types of gas turbines.

As is apparent from the above description, in accordance with the gas turbine vane according to the exemplary embodiment of the present disclosure, it is possible to reduce or prevent the obstruction between the impinging jet and the gap flow by previously dispersing the gap flow using the posts. Thus, it is possible to further increase the cooling performance of the vane in the downstream of cooling air, compared to the related art.

Although the preferred embodiments have been disclosed for illustrative purposes, those skilled in the art will appreciate that various modifications, additions and substitutions are possible, without departing from the scope and spirit of the accompanying claims and their equivalents. Furthermore, the above advantages and features are provided in described embodiments, but shall not limit the application of such issued claims to processes and structures accomplishing any or all of the above advantages.

What is claimed is:

1. A gas turbine vane, comprising:

an airfoil having an inflow chamber for introducing cooling air, a leading edge, a trailing edge, and a sidewall between the leading edge and the trailing edge, a plurality of film holes being defined in the sidewall and communicating with the inflow chamber, and a cut-back disposed proximal to the trailing edge and defined by the sidewall;

an insert disposed within the sidewall and spaced apart from an inner surface of the sidewall to create a gap permitting a gap flow of the cooling air toward the trailing edge, a plurality of insert holes being defined in the insert and arranged in a plurality of rows, each of the plurality of rows of insert holes including insert holes arranged in a straight line from the leading edge to the trailing edge; and a plurality of posts extending from the sidewall and contacting an outer surface of the insert, wherein each of the plurality of insert holes is configured to create an impinging jet of the cooling air from the inflow chamber into the gap, wherein each of the plurality of posts is disposed in the gap adjacent to a corresponding one of the plurality of insert holes and includes a first side facing toward the leading edge and a second side facing toward the trailing edge, each of the first and second sides including a sidewall end coupled to the inner surface of the sidewall and an insert end coupled to the outer surface of the insert and separated from the corresponding one of the plurality of insert holes in a direction of the gap flow of the cooling air, wherein the insert end of the second side of at least one of the plurality of posts is disposed upstream of the corresponding one of the plurality of insert holes in the direction of the gap flow of the cooling air, and the sidewall end of the second side of the at least one of the plurality of posts is disposed downstream of the corresponding one of the plurality of insert holes in the direction of the gap flow of the cooling air, wherein the first side of each of the plurality of posts is disposed perpendicularly with respect to each of the sidewall end and the insert, and wherein the second side of the at least one of the plurality of posts includes an inclined surface configured to receive the impinging jet of the corresponding one of the plurality of insert holes before the impinging jet impinges on the sidewall, and maintain separation between the gap flow and the impinging jet of the corresponding one of the plurality of insert holes until the gap flow passes the inclined surface of the at least one of the plurality of posts.

2. The gas turbine vane according to claim 1, wherein the second side of each of the plurality of posts extends from its insert end to its sidewall end in a direction toward the trailing edge, such that the sidewall end of the second side of at least one of the plurality of posts is closer to the trailing edge than is the insert end of the second side of the at least one of the plurality of posts.

3. The gas turbine vane according to claim 1, wherein each of the plurality of posts is respectively disposed between two insert holes along a direction of the rows.

4. The gas turbine vane according to claim 1, wherein each of the rows is offset from an adjacent row.

5. The gas turbine vane according to claim 1, wherein each of the plurality of posts includes a partition portion extending toward the leading edge from a side of the post.

6. The gas turbine vane according to claim 1, wherein a shape of a cross section of at least one of the posts is selected from the group consisting of circular, semicircular, oval, triangular, and square.

7. The gas turbine vane according to claim 1, wherein the second side is curved.

8. The gas turbine vane according to claim 7, wherein the second side is concave.

9. The gas turbine vane according to claim 1, wherein the plurality of insert holes include first and second insert holes in each row of insert holes, the first insert hole disposed toward the leading edge and the second insert hole disposed toward the trailing edge, and wherein each of the plurality of posts is disposed on the straight line closer to the second insert hole than the first insert hole.

10. A gas turbine comprising:

a compressor configured to draw and compress air;

a combustor configured to mix the air compressed by the compressor with fuel; and a turbine configured to rotate a plurality of turbine blades using gas discharged from the combustor and to produce electric power, wherein:

the compressor includes a plurality of compressor blades and a plurality of compressor vanes that are alternately arranged;

the turbine includes the plurality of turbine blades and a plurality of turbine vanes that are alternately arranged;

at least one of the compressor vanes and the turbine vanes includes:

an airfoil having an inflow chamber for introducing cooling air, a leading edge, a trailing edge, and a sidewall between the leading edge and the trailing edge, a plurality of film holes being defined in the sidewall and communicating with the inflow chamber, and a cut-back disposed proximal to the trailing edge and defined by the sidewall;

an insert disposed within the sidewall and spaced apart from an inner surface of the sidewall to create a gap permitting a gap flow of the cooling air toward the trailing edge, a plurality of insert holes being defined in the insert and arranged in a plurality of rows, each of the plurality of rows of insert holes including insert holes arranged in a straight line from the leading edge to the trailing edge; and a plurality of posts extending from the sidewall and contacting an outer surface of the insert, wherein each of the plurality of insert holes is configured to create an impinging jet of the cooling air from the inflow chamber to impinge on the sidewall, wherein each of the plurality of posts is disposed in the gap adjacent to a corresponding one of the plurality of insert holes and includes a first side facing toward the leading edge and a second side facing toward the trailing edge, each of the first and second sides including a sidewall end coupled to the inner surface of the sidewall and an insert end coupled to the outer surface of the insert and separated from the corresponding one of the plurality of insert holes in a direction of the gap flow of the cooling air, wherein the insert end of the second side of at least one of the plurality of posts is disposed upstream of the corresponding one of the plurality of insert holes in the direction of the gap flow of the cooling air, and the sidewall end of the second side of the at least one of the plurality of posts is disposed downstream of the corresponding one of the plurality of insert holes in the direction of the gap flow of the cooling air, wherein the first side of each of the plurality of posts is disposed perpendicularly with respect to each of the sidewall end and the insert, and wherein the second side of the at least one of the plurality of posts includes an inclined surface configured to receive the impinging jet of the corresponding one of the plurality of insert holes before the impinging jet impinges on the sidewall, and maintain separation between the gap flow and the impinging jet of the corresponding one of the plurality of insert holes until the gap flow passes the inclined surface of the at least one of the plurality of posts.

11. The gas turbine according to claim 10, wherein the second side of each of the plurality of posts extends from its insert end to its sidewall end in a direction toward the trailing edge, such that the sidewall end of the second side of at least one of the plurality of posts is closer to the trailing edge than is the insert end of the second side of the at least one of the plurality of posts.

12. The gas turbine according to claim 10, wherein each of the plurality of posts is respectively disposed between two insert holes along a direction of the rows.

13. The gas turbine according to claim 10, wherein each of the rows is offset from an adjacent row.

14. The gas turbine according to claim 10, wherein each of the plurality of posts includes a partition portion extending toward the leading edge from a side of the post.

15. The gas turbine according to claim 10, wherein the plurality of insert holes include first and second insert holes in each row of insert holes, the first insert hole disposed toward the leading edge and the second insert hole disposed toward the trailing edge, and wherein each of the plurality of posts is disposed on the straight line closer to the second insert hole than the first insert hole.

* * * * *